US005915987A

United States Patent [19]

Reed et al.

[11] Patent Number: 5,915,987

[45] Date of Patent: Jun. 29, 1999

[54] LATCHED ELECTRICAL CONNECTOR

[75] Inventors: Gary W. Reed, Beaverton; William R. Mark, Hillsboro; Paul K. Andersen, Aloha, all of Oreg.

[73] Assignee: Tektronix, Inc., Wilsonville, Oreg.

[21] Appl. No.: 08/933,390

[22] Filed: Sep. 19, 1997

[51] Int. Cl.[6] ..... H01R 13/62

[52] U.S. Cl. ..... 439/352; 439/258

[58] Field of Search ..... 439/350–8, 607–10, 439/258, 345, 470

[56] References Cited

U.S. PATENT DOCUMENTS 5,634,809 6/1997 Hirai ..... 439/352

*Primary Examiner*—Neil Abrams

*Assistant Examiner*—Eugene G. Byrd

*Attorney, Agent, or Firm*—Bennet K. Langlotz; Thomas F. Lenihan

[57] ABSTRACT

A latching electrical connector with a body connectable to a receptacle and having a latch mechanism that mechanically engages the receptacle to resist disconnection. A flexible electrical cable extends from the body, and a grip element is connected to the latch mechanism to unlatch the mechanism upon pulling. The grip element is flexibly connected to the latch mechanism so that it may be folded aside to provide a compact arrangement.

20 Claims, 3 Drawing Sheets

LATCHED ELECTRICAL CONNECTOR

FIELD OF THE INVENTION

The invention relates to electrical connectors, and more particularly to cable connectors having latches providing enhanced retention force and reduced detachment force upon actuation.

BACKGROUND AND SUMMARY OF THE INVENTION

Electrical connectors with locking mechanisms are useful to prevent unintended disconnection. One application involves a cable terminating at a removable connection to a mating connection on a chassis or printed circuit board in an electronic instrument. Typically, such connectors have a latch mechanism that normally has a very high or unlimited extraction force, but which has a handle that releases the mechanism to provide a low, limited extraction force. This prevents the connector from loosening or disconnecting unintentionally due to environmental vibrations or jostling during servicing of other portions of the instrument.

Often, such release handles operate by motion in the direction in which the connector is extracted from the mating connector portion, such that a user applies force to the release handle in a natural, intuitive direction.

In applications such as connection to printed circuit boards connectors in computers and other electronic instruments, printed circuit boards are often arranged in parallel arrays spaced apart by limited gaps to allow a compact instrument housing. With such limited "headroom" extending perpendicularly from each board, a connector that might naturally extract perpendicularly from the board would not have sufficient room to allow the use of a latching connector with a release handle extending in the extraction direction. Although the board might be removed from the instrument prior to extraction of the connector, an extraction handle would protrude substantially into the space occupied by an adjacent board. Thus, a designer must choose between the benefits of closely spaced circuit boards versus latching connectors with a perpendicular extraction direction.

The embodiments disclosed herein overcome these limitations by providing a latching electrical connector with a body connectable to a receptacle and having a latch mechanism that mechanically engages the receptacle to resist disconnection. A flexible electrical cable extends from the body, and a grip element is connected to the latch mechanism to unlatch the mechanism upon pulling. The grip element is flexibly connected to the latch mechanism so that it may be folded aside to provide a compact arrangement.

DETAILED DESCRIPTION OF A PREFERRED EMBODIMENT

Figure 1:
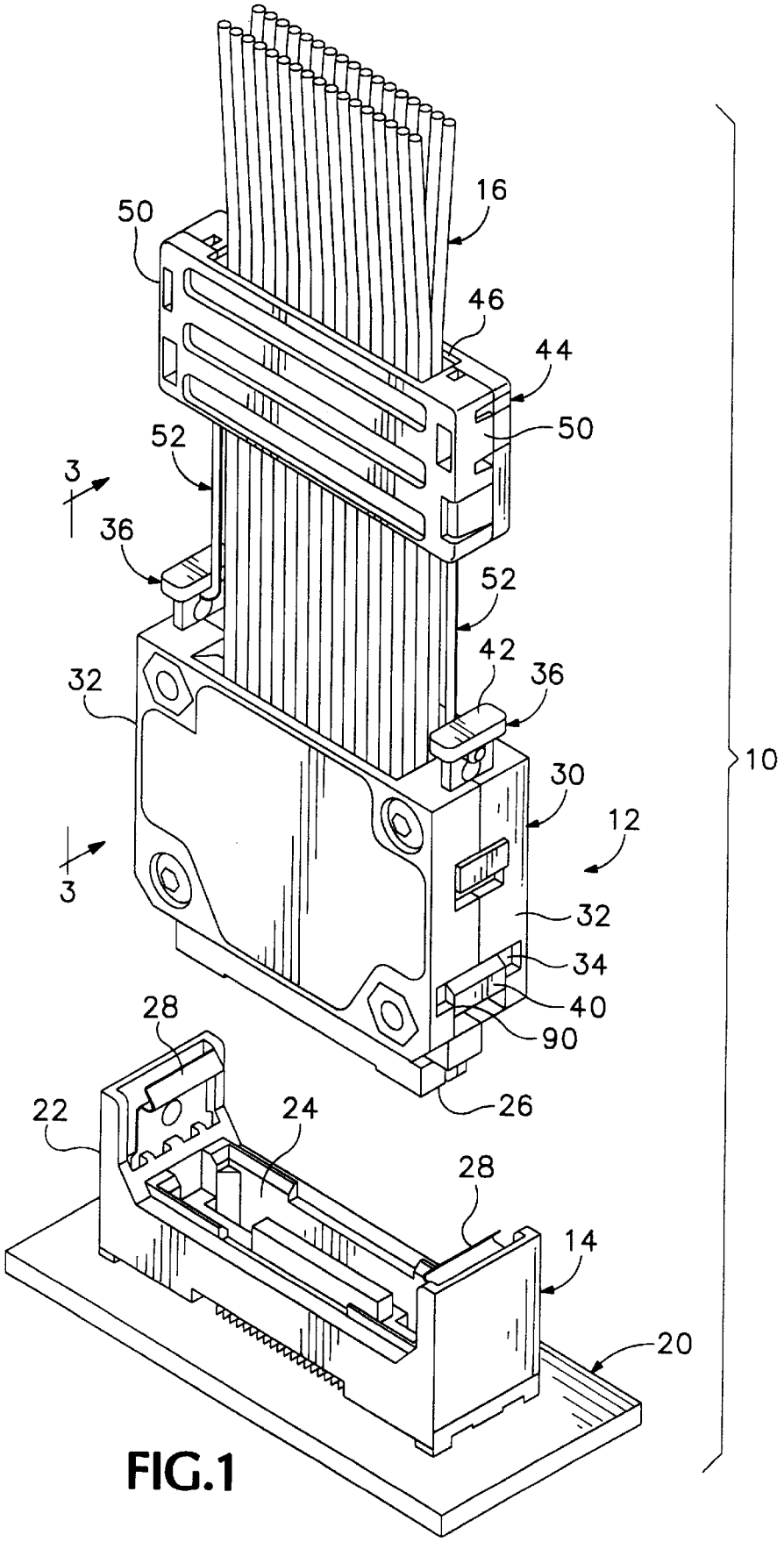
FIG. 1 is an isometric view of a connector according to a preferred embodiment of the invention.

FIG. 1 shows a latching electrical connector set 10 having a male connector portion 12 and a female connector portion 14. The male portion 12 is the terminus of a multi-stranded flexible ribbon cable 16, and the female portion 14 is connected to a printed circuit board 20 or chassis of an electronic instrument.

The female portion 14 includes a housing 22 defining an elongated rectangular pocket 24 that receives a nose end 26 of the male portion 12. At each end of the pocket, a latch spring 28 extends up from the board 20, and has a free end portion that is bent inward to form an inwardly protruding latch as will be discussed below.

The male portion 12 of the connector has a flat rectangular head 30, with the cable 16 extending away along a primary axis parallel to the major faces of the head, in a direction opposite the nose end 26. The connector head 30 has opposed edge faces 32 that correspond to the ends of the female connector, and which are substantially in line with the edges of the ribbon cable 16.

A latch pocket 34 defined in each edge face 32 provides a recess for engagement by a respective one of the latch springs 28. Each pocket 34 is located near the nose end 26, and is an elongated rectangular recess that extends nearly from one major face of the head to the other. A sliding cam element 36 is captured within the head 30 to slide in a path parallel to the primary axis of the cable, just beneath the edge surface 32. A sloped lobe 40 at one end of the cam may partially occupy the latch pocket to force the spring out of the pocket to unlatch the connector. A tail end 42 of each cam element 36 protrudes from the head 30 along the edges of the ribbon cable.

A grip sleeve 44 spaced apart from the male connector head is a flat rectangular body that defines a rectangular passage 46 through which the cable 16 loosely passes. The sleeve has opposed ends 50 encompassing the edges of the ribbon cable. A flexible elongated tie member 52 extends from each end of the grip sleeve and is connected to the tail end 42 of a respective cam element. Thus, the latch may be released by a user gripping the sleeve and pulling it perpendicularly away from the board 20. The tension transmitted through the ties 52 serves both to slide the cams to displace the latch springs, and to provide the necessary withdrawal force to extract the male portion from the female portion of the connector. While the connector is connected and latched, the cable may be folded perpendicularly between the sleeve and the head so that the cable and sleeve are parallel to the board 20. This reduces the headroom required for the connector and allows limited spacing between the board shown and another board that might be positioned just above it.

Figure 2:
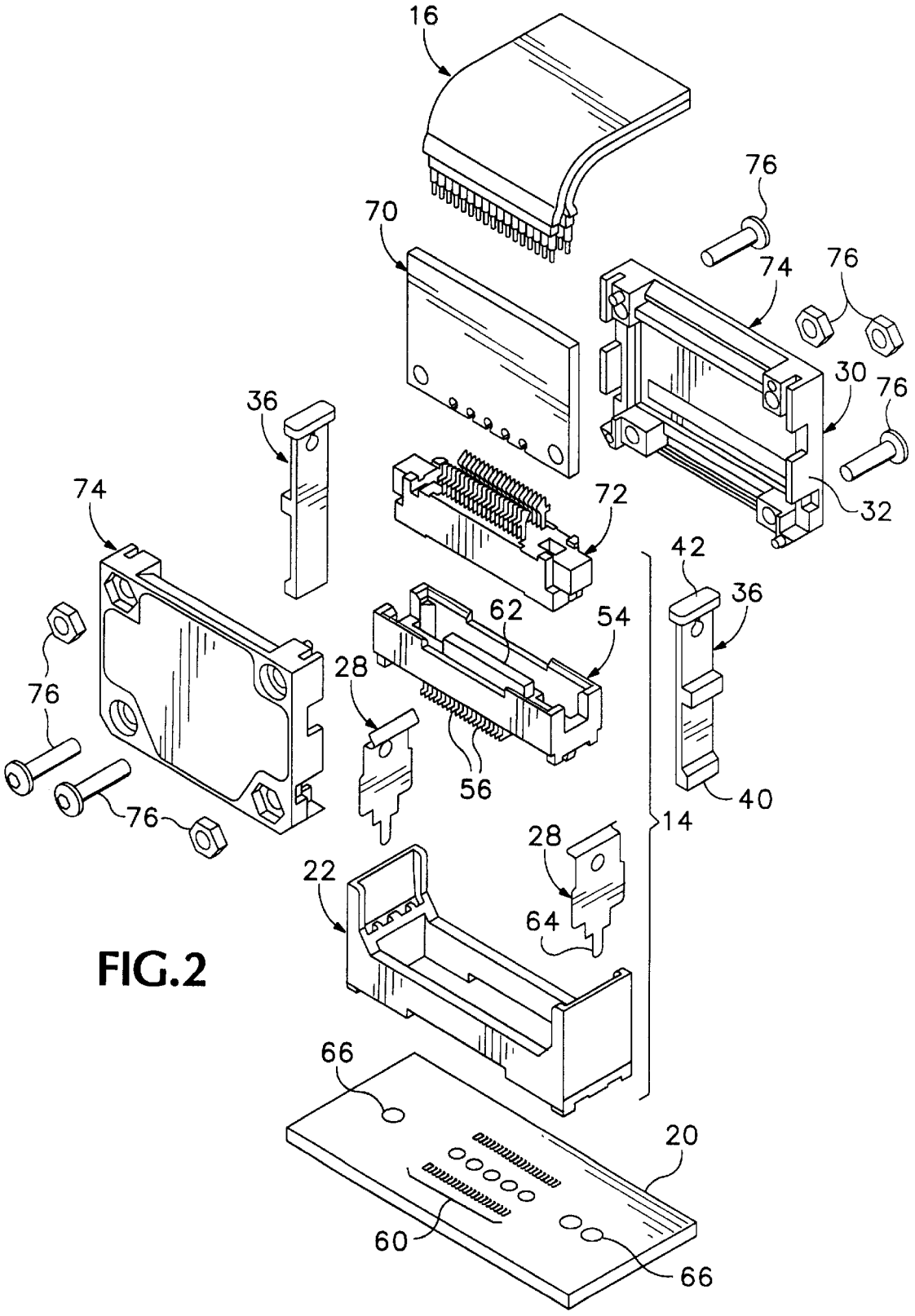
FIG. 2 is an exploded view of the connector of FIG. 1.

As shown on detail in FIG. 2, the female connector portion 14 includes an electrical portion 54 having lower leads 56 arranged in rows that permit soldering to a corresponding array of lands 60 on the board 20. Each lead is also connected within the electrical portion 54 to a corresponding conductive land on an elongated tongue 62 that extends within the electrical portion. The electrical portion is closely received in the housing portion 22, which is secured to the board by positioning the springs in the housing 22, inserting downwardly extending spring tabs 64 into plated through holes 66 in the board, and soldering them in place.

The male portion 72 is assembled by soldering the wires of the ribbon cable 16 to lands on a connector board 70. A male electrical portion 72 has extending leads that receive an edge of the board 70 and provide electrical connections to lands that matably contact the lands on the tongue of the female electrical portion 54 when the connector is connected. The cam elements 36 and electrical portions 70, 72 are captured between clam shell halves 74 of the male connector head 30, which are secured together by screw and nut fasteners 76. The grip element is also formed as a two part clamshell that snaps together to surround the ribbon cable. Each tension tie 52 has an enlarged end, which is captured in a pocket defined between the two grip halves when they are snapped together, and which extends toward the rest of the connector. Each cam defines a key hole aperture having a large portion through which an enlarged end of each tie is inserted, and a narrow slot sized to closely receive the neck of a tie and to prevent passage of the tie end.

Figure 3A:
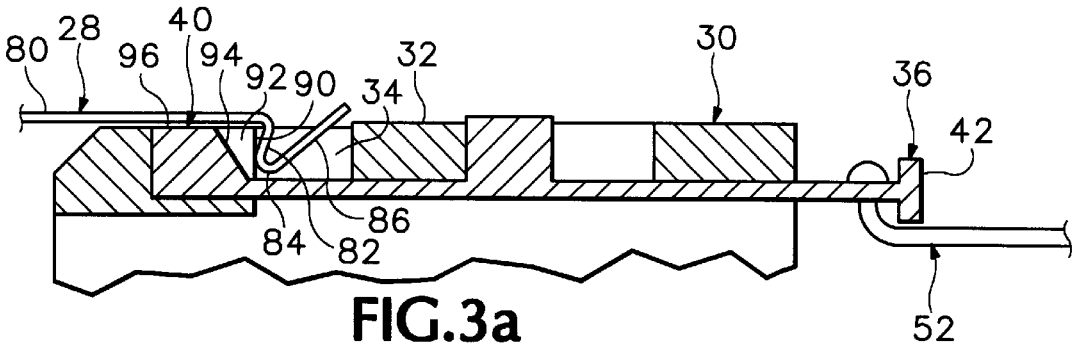
FIGS. 3*a* and 3*b* are enlarged sectional views of the connector of FIG. 1, taken along line 3—3.
Figure 3B:
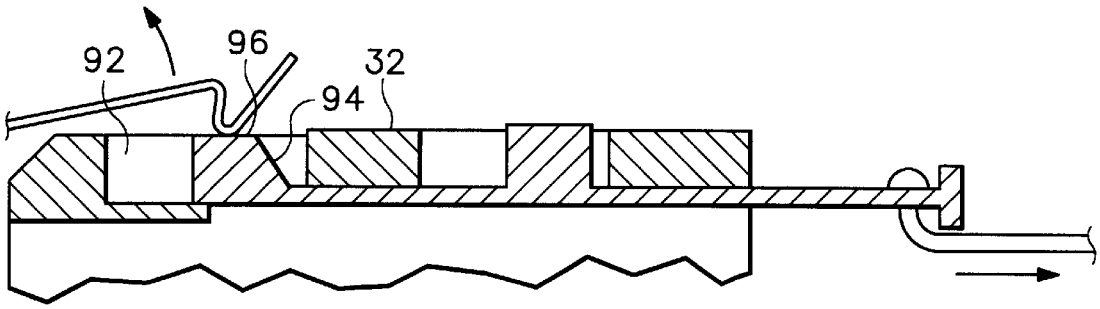

FIGS. 3*a* and 3*b* show the operation of the cam and latch mechanism. In FIG. 3*a*, the mechanism is in a latched position preventing connector extraction; in FIG. 3*b*, the mechanism is in an unlatched position permitting withdrawal. The latch spring 28 has a major planar portion 80 that extends from the board to an angled portion 82, which is offset by more than 90 degrees from the major portion to extend into the pocket 34 when the connector is latched. The angled portion is offset by at least 90 degrees to avoid a camming action that would cause the spring to be displaced outwardly upon forcible extraction of the connector. The angled portion extends to a nose bend 84, and the spring terminates in a gently angled guide portion 86 that allows the spring to cam outward upon connector insertion.

The connector head pocket 34 includes a strike wall 90 normal to the primary connector axis. The strike wall does not extend the full width of the pocket 34, but extends on both sides of a pocket extension 92 that permits the lobe of the cam to be positioned past the strike wall when in the latched position. The lobe 40 of the cam element 36 has an angled cam surface 94 that faces at about a 45 degree angle toward the cable direction and laterally away from the connector head so that it contacts the spring nose 84 when the cam is shifted to the position of FIG. 3*b*. The lobe has a sufficient thickness so that an outer surface 96 parallel to the edge surface 32 is substantially coplanar therewith. When the cam is shifted to the unlatched position of FIG. 3*b*, the nose of the spring rides the angled cam surface 94 and onto the outer surface 96. In this position, the center of the nose is resting on the cam, while the end portions are suspended above the ends of the pocket 34. As the connector is withdrawn, the spring nose slides across surface 96 until its ends begin to slide onto the connector surface 32 for support. Then, the center of the nose may continue beyond the end of the cam surface 96 and extraction may readily proceed.

Figure 4:
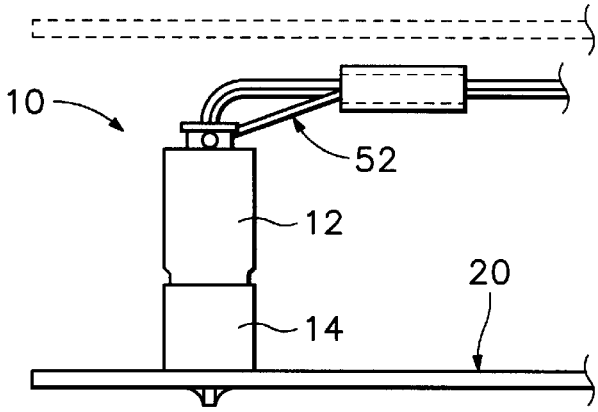
FIG. 4 is a side view of the connector of FIG. 1.

As shown in FIG. 4, after a connection is made, the cable may be bent or folded by 90 degrees into parallel with the board so that the connector and cable do not protrude above the board by much more that the height of the connector head. The length of the ties is sufficient that the cable may bend without force or binding between the connector head and the grip sleeve.

In the preferred embodiment, the connector head has an overall width and length of 1.0 inch (25 mm), and a thickness of about 0.4 inch (10 mm). The ribbon cable has a width of 0.7 inch (18 mm). The ties 52 have a length that permits a spacing of 0.6 inch (15 mm) between the ends 42 of the sliders 36 and the nearest surface of the sleeve 44 when the cable is straight. The sleeve has a width of about 1.0 inch (25 mm), a length of 0.5 inch (12 mm) and a thickness of about 0.2 inch (5 mm). When the connector is connected to a board mounted socket and the cable and sleeve folded flat, the connector protrudes above the board surface by a limited 1.2 inch (30 mm).

While the disclosure is made in terms of a preferred embodiment, the invention is not intended to be so limited.

We claim:

1. An electrical connector for connection to a receptacle having a receptacle electrical contact and a mechanical latch element, the connector comprising:

a body;

a connector electrical contact positioned to contact the receptacle electrical contact when the connector is connected to the receptacle;

a flexible electrical conductor extending from the body and connected to the connector electrical contact;

a movable connector latch attached to the body and movable relative to the body between an engaged position and a disengaged position, such that the latch engages the receptacle latch element only when in the engaged position;

a grip connected to the connector latch and operable to move the connector latch between the engaged position and the disengaged position; and a flexible tension element connecting the grip to the connector latch.

2. The connector of claim 1 wherein the grip is spaced apart from the body, such that the grip may be angularly disposed with respect to the body.

3. The connector of claim 1 wherein the grip is a sleeve defining a passage.

4. The connector of claim 3 wherein the electrical conductor passes through the passage.

5. The connector of claim 1 wherein the connector engages the receptacle by movement along a connection axis, and wherein the grip is angularly movable relative to the body away from the axis.

6. The connector of claim 5 wherein the connector latch includes a receptacle engaging portion movable in a direction angularly offset from the connection axis into and out of engagement with the receptacle latch.

7. The connector of claim 6 wherein the connector latch includes a cam element connected to the tension element and movable in a direction substantially parallel to the connection axis, such that pulling on the grip moves the cam element, which disengages the latch.

8. The connector of claim 1 wherein the conductor is a ribbon cable.

9. The connector of claim 8 including a pair of tension elements, each connected to the grip near a respective edge of the ribbon cable.

10. The connector of claim 1 wherein the tension elements are elongated electrically non-conductive members.

11. A latching electrical connector comprising:

a body connectable to a receptacle;

the body including a latch mechanism operable to mechanically engage the receptacle when the body is connected to the receptacle and resist disconnection from the receptacle;

a flexible electrical cable extending from the body;

a grip element operably connected to the latch mechanism such that pulling the grip element away from the body disengages the body from the receptacle; and the grip element being flexibly connected to the latch mechanism such that the grip element may be angularly disposed with respect to the body to permit the grip element to be folded aside to provide a compact arrangement.

12. The connector of claim 11 wherein the grip element is a sleeve surrounding the cable.

13. The connector of claim 12 wherein the cable is a ribbon cable, and the grip element defines an elongated passage receiving the cable and having a passage end corresponding to a respective edge of the ribbon cable.

14. The connector of claim 13 including a pair of elongated flexible tension members connecting the grip element to the latch mechanism, each tension member being connected to the grip element near a respective passage end.

15. The connector of claim 11 including an elongated flexible tension member connecting the grip element to the latch mechanism.

16. The connector of claim 11 wherein the grip element is spaced apart from the body.

17. An electrical connector comprising:

matable and separable first and second portions movable relative to each other along a connection axis between a connected position and a disconnected position;

the first portion having a latch member movable between an engaged position and a disengaged position;

the second portion including a cam movable through a cam path between a locked position and a released position;

the second portion including a ledge element positioned to be engaged by the latch member in the engaged position when the connector is in the connected position and the cam is in the locked position;

the cam having a ramp surface angularly offset from the perpendicular to the connection axis and operable to move the latch to the disengaged position when the cam is moved to the released position; and a grip element spaced apart from the second portion and connected to the cam such that tension on the grip element moves the cam to the released position.

18. The connector of claim 17 wherein the grip element is angularly disposable with respect to the second portion such that it may be repositioned while connected to provide a compact profile.

19. The connector of claim 17 wherein the cam is movable along the connection axis in response to tension by the grip element.

20. The connector of claim 17 wherein the grip element is a sleeve surrounding the cable.

* * * * *